US008354907B2

(12) United States Patent
Fukaya et al.

(10) Patent No.: US 8,354,907 B2
(45) Date of Patent: Jan. 15, 2013

(54) SUPERCONDUCTING COIL ASSEMBLY AND MAGNETIC FIELD GENERATING EQUIPMENT

(75) Inventors: Atsuko Fukaya, Tokyo (JP); Tomoya Oota, Urayasu (JP); Hidehiko Sugimoto, Kasugai (JP)

(73) Assignee: IHI Corporation (JP)

( * ) Notice: Subject to any disclaimer, the term of this patent is extended or adjusted under 35 U.S.C. 154(b) by 14 days.

(21) Appl. No.: 13/057,594

(22) PCT Filed: Aug. 5, 2009

(86) PCT No.: PCT/JP2009/003756

§ 371 (c)(1),
(2), (4) Date: Feb. 4, 2011

(87) PCT Pub. No.: WO2010/016254

PCT Pub. Date: Feb. 11, 2010

(65) Prior Publication Data

US 2011/0140817 A1 Jun. 16, 2011

(30) Foreign Application Priority Data

Aug. 6, 2008 (JP) ..... 2008-202807

(51) Int. Cl.
*H01F 6/00* (2006.01)
*H01F 7/00* (2006.01)

(52) U.S. Cl. ..... 335/216; 335/301

(58) Field of Classification Search ..... 335/216, 335/301; 336/DIG. 1; 310/54; 505/876–880
See application file for complete search history.

(56) References Cited

U.S. PATENT DOCUMENTS 5,476,633 A * 12/1995 Sokolowski et al. ..... 419/57
7,355,307 B2 4/2008 Steinmeyer ..... 310/52

FOREIGN PATENT DOCUMENTS

| | | | |
|---|---|---|---|
| JP | 3-155103 | | 7/1991 |
| JP | 5-144628 | A | 6/1993 |
| JP | 07-142235 | | 6/1995 |
| JP | 7-142245 | A | 6/1995 |
| JP | 11-018290 | | 1/1999 |
| JP | 11-031614 | | 2/1999 |
| JP | 2001-6920 | A | 1/2001 |
| JP | 2002-153441 | | 5/2002 |
| JP | 2003-158009 | A | 5/2003 |
| JP | 2004-342972 | A | 12/2004 |
| JP | 2005-510997 | A | 4/2005 |
| JP | 2005-191539 | A | 7/2005 |
| JP | 2007-60748 | A | 3/2007 |
| SU | 1229827 | A1 | 5/1986 |

(Continued)

OTHER PUBLICATIONS

Office Action dated May 25, 2012 issued in corresponding Russian Patent Application No. 2011108111 with English translation (6 pages).

(Continued)

*Primary Examiner* — Ramon Barrera
(74) *Attorney, Agent, or Firm* — Ostrolenk Faber LLP

(57) ABSTRACT

Superconducting coil assemblies (100) in which a plurality of coil units (110) composed of superconducting material are arranged coaxial to the same direction, and including magnetic field adjusting members (121) composed of ferrite, powder metallurgical core, or permendur powder, which have higher magnetic permeability than said superconducting material and are provided in the vicinities of said coil units.

4 Claims, 9 Drawing Sheets

FOREIGN PATENT DOCUMENTS

| | | |
|---|---|---|
| WO | WO 96/12288 | 4/1996 |

OTHER PUBLICATIONS

Office Action dated Oct. 9, 2012 issued in corresponding Japanese Patent Application No. 2008-202807 with English translation (6 pages).

Russian Federation Decision on Grant, dated Oct. 29, 2012, issued in corresponding Russian Patent Application No. 2011108111/07(011619), filed Aug. 5, 2009. Total 10 pages.

European Search Report, dated Nov. 8, 2012 issued in corresponding European Application No. EP 09804741.8. Total 6 pages.

International Search Report dated Nov. 17, 2009, issued in corresponding international application No. PCT/JP2009/003756.

Maitham K. Al-Mosawi et al., "The Effect of Flux Diverters on AC Losses of a 10k VA High Temperature Superconducting Demonstrator Transformer", IEEE Transactions on Applied Superconductivity, vol. 11, No. 1, Mar. 2001, pp. 2800-2803.

M.K. Al-Mosawi et al., "Design of a 100 kVA high temperature superconducting demonstration synchronous generator," Physica C372-376 (2002), pp. 1539-1542.

* cited by examiner

SUPERCONDUCTING COIL ASSEMBLY AND MAGNETIC FIELD GENERATING EQUIPMENT

CROSS REFERENCE TO RELATED APPLICATIONS

The present application is a 35 U.S.C. §371 National Phase conversion of PCT/JP2009/003756, filed Aug. 5, 2009, which claims benefit of Japanese Application No. 2008-202807, filed Aug. 6, 2008, the disclosure of which is incorporated herein by reference. The PCT International Application was published in the Japanese language.

TECHNICAL FIELD

The present invention relates to a superconducting coil assembly and a magnetic field generating equipment.

BACKGROUND ART

There is a superconducting coil assembly which is formed by, for example, winding a tape-shaped superconducting member that is bismuth-based, yttrium-based, or such like, around a bobbin to form a coil unit in a shape such as a pancake, a fan, or a racetrack, and then arranging a plurality of these coil units coaxial to the same direction.

In such a superconducting coil assembly, the magnitude of critical current of the superconducting member is known to depend on the strength of the magnetic field acting on the superconducting member. More specifically, the magnitude of critical current of the superconducting member mainly depends on the strength of the magnetic field acting in a direction that is perpendicular to a wide surface of the superconducting wire tape (i.e. the diameter direction of the coil unit), and the magnitude of critical current decreases as the strength of the magnetic field in the perpendicular direction increases. Also, in a superconducting coil assembly for AC current, there is a problem of loss (AC loss) due to an alternating magnetic field, which is a characteristic of superconductivity.

To counter this problem, Patent Document 1 discloses a member wherein magnetic field adjusting members, made by dispersing iron powder composed of a ferromagnetic material such as pure iron in resin, are arranged via electrical insulating members between coil units that are adjacent in the axial direction. According to this structure, magnetic flux penetrating the superconducting material is captured by the magnetic field adjusting members, thereby the strength of the magnetic field acting on the superconducting material in the diameter direction is reduced and a reduction in critical current is suppressed.

[Prior Art Documents]

[Patent Documents]

[Patent Document 1] Japanese Patent Publication No. 2004-342972

DISCLOSURE OF INVENTION

Problems to be Solved by the Invention

Since the magnetic field adjusting member according to Patent Document 1 is made from iron powder dispersed in resin, it has high electrical resistance, can suppress eddy current caused by a varying magnetic field, and can suppress generation of heat caused by the alternating magnetic field. However, this magnetic field adjusting member has low magnetic permeability, and for that reason cannot sufficiently capture the magnetic flux penetrating the superconducting material.

Moreover, the magnetic field adjusting members according to Patent Document 1 are arranged between the coil units with no consideration for the fact that magnetic field distribution depends on the position in the superconducting coil assembly. For example, at the center in the axial direction of the superconducting coil assembly, the magnetic field perpendicular to the superconducting member is lower than the magnetic field at the ends of the axial direction. Consequently, if a magnetic field adjusting member having a predetermined size is provided around the center where the magnetic field is low, the magnetic flux could contrarily be led to the superconducting coil units around the center.

The present invention has been performed in consideration of the problems described above, and aims to provide a superconducting coil assembly and a magnetic field generating equipment that can suppress a reduction in critical current, and suppress AC loss.

Means for Solving the Problems

To solve the above-mentioned problems, the present invention provides a superconducting coil assembly in which a plurality of coil units composed of superconducting material are arranged coaxial to the same direction, including magnetic field adjusting members composed of ferrite, powder metallurgical core, or permendur powder, which have higher magnetic permeability than the superconducting material and are provided in the vicinities of the coil units.

According to this configuration, in the present invention, the magnetic field adjusting members are composed of ferrite, powder metallurgical core, or permendur powder. Therefore, the magnetic field adjusting members of the present invention have high electrical resistivity and can suppress eddy current. In addition, the magnetic field adjusting members of the present invention have high magnetic permeability, and can sufficiently capture magnetic flux.

In the present invention, the magnetic field adjusting members are arranged between the coil units, so as to sandwich each coil unit in the axial direction, or so as to sandwich coil units at both ends in the axial direction.

According to this configuration, in the present invention, the magnetic field adjusting members are provided between the coil units, so as to sandwich each coil unit in the axial direction, or so as to sandwich coil units at both ends in the axial direction.

Furthermore, in the present invention, the magnetic field adjusting members have widths in the axial direction and/or widths in a direction orthogonal to the axis depending on the magnetic field distribution at their arranged positions.

According to this configuration, by adjusting the size of the magnetic field adjusting members depending on the magnetic field distribution, the magnetic field adjusting members can capture magnetic flux appropriate to their arranged positions.

Furthermore, in the present invention, the magnetic field adjusting members are shaped of a ring coaxial to the axis of the coil units.

According to this configuration, in the present invention, since the magnetic field adjusting members are ring-shaped, they can capture magnetic flux acting on the coil units in any direction from the diameter direction.

Furthermore, in the present invention, inner ring members which are provided on diameter-direction inner sides of the magnetic field adjusting members, and outer ring members which are provided separately on diameter-direction outer sides of the magnetic field adjusting members, are larger in the axial direction than the magnetic field distribution-adjusting members.

According to this configuration, in the present invention, loads exerted on the inner ring member and the outer ring member (e.g. a magnetic force acting on the magnetic field adjusting member in the magnetic field, a force generated when fixing it to the coil stack, a force generated by difference in the thermal expansion coefficients between the magnetic field adjusting member and the resin material during cooling (or rising temperature), etc.) can be received. Therefore, even if the magnetic field adjusting member is a brittle material such as ferrite, damage and the like due to the loads mentioned above, collisions, and so forth, can be prevented.

The present invention further provides a magnetic field generating equipment that comprises the above-described superconducting coil assembly, generates a magnetic field using drive current supplied to each coil unit from outside.

According to this configuration, the present invention obtains a magnetic field generating equipment including the superconducting coil assembly that can further suppress a reduction in critical current, and can suppress AC loss.

Effects of the Invention

According to the superconducting coil assembly of the present invention, a plurality of coil units composed of superconducting material are arranged coaxial to the same direction. Magnetic field adjusting members composed of ferrite, powder metallurgical core, or permendur powder, which have higher magnetic permeability than the superconducting material, are arranged in the vicinities of the coil units. Therefore, in the present invention, the superconducting coil assembly has high electrical resistivity and can suppress eddy current. In addition, the superconducting coil assembly of the present invention has high magnetic permeability, and can sufficiently capture magnetic flux.

Therefore, the superconducting coil assembly of the present invention achieves a magnetic field generating equipment including a superconducting coil assembly that can further suppress a reduction in critical current and can suppress AC loss.

BEST MODE FOR CARRYING OUT THE INVENTION

An embodiment of the present invention will be explained with reference to the drawings. Firstly, a schematic configuration of a superconducting motor (magnetic field generating equipment) including a superconducting coil assembly according to the embodiment will be explained.

Figure 1:
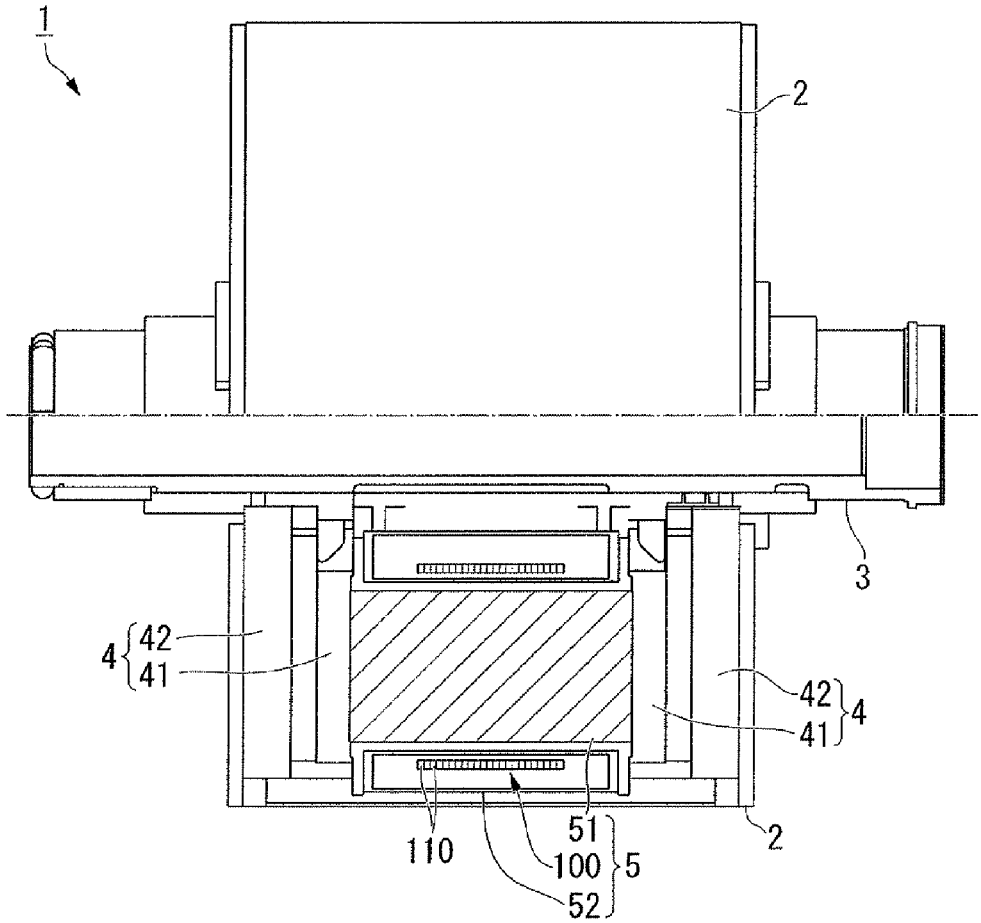
FIG. 1 is a partial exploded view of a schematic configuration of a superconducting motor according to an embodiment of the present invention.

FIG. 1 is a partial exploded view of a schematic configuration of a superconducting motor 1 according to an embodiment of the present invention.

As shown in FIG. 1, the superconducting motor 1 includes a casing 2, a motor shaft 3, rotors 4, and a stator 5.

The casing 2 has a hollow circular cylindrical shape, and an opening is formed around its center axis to insert the motor shaft 3.

The motor shaft 3 is inserted into the opening in the casing 2, and rotates freely around a rotation axis extending in the axial direction with respect to the casing 2.

A pair of rotors 4 is provided inside the casing 2, and sandwich the stator 5 in the axial direction. The rotors 4 connected to the motor shaft 3 can rotate freely with respect to the casing 2. Permanent magnets 41 are provided on one side of each rotor 4 and face the stator 5, back yokes 42 are also provided as a magnetic path on the back face of the permanent magnet 41.

The stator 5 is provided inside the casing 2 and is fixed to the casing 2. The stator 5 includes iron cores 51 which extend in the axial direction thereof and face the permanent magnets 41, superconducting coil assemblies 100 provided around the iron cores 51, and a cryostat 52 that surrounds the superconducting coil assemblies 100.

The iron core 51 amplifies the magnetic flux generated by each coil unit 110, and gathers the magnetic flux.

The superconducting coil assembly 100 includes a plurality of coil units 110 arranged coaxial to the same direction. The superconducting coil assembly 100 generates a magnetic field by supplying driving current (AC current) to each coil unit 110 from outside.

The cryostat 52 is a thermal insulation cooling medium container in order to keep the superconducting coil assemblies 100 at extremely low temperatures, and stores an extremely low-temperature cooling medium such as liquid nitrogen, liquid neon, or liquid helium.

In the superconducting motor 1 having the above-described configuration, AC current is supplied from outside to the superconducting coil assemblies 100, thereby an N pole and an S pole are alternately generated at the ends of each iron core 51 in accordance with the AC cycle. Attraction and repulsion forces act between the iron core 51 and the permanent magnets 41 in the rotors 4, whereby the rotors 4 rotate around its axis. In response to the rotation of the rotors 4, the motor shaft 3 rotates with respect to the casing 2, and the superconducting motor 1 obtains a desired rotational driving force.

Subsequently, the configuration of the superconducting coil assembly 100 of the superconducting motor 1 will be explained in detail with reference to FIGS. 2 to 4.

Figure 2:
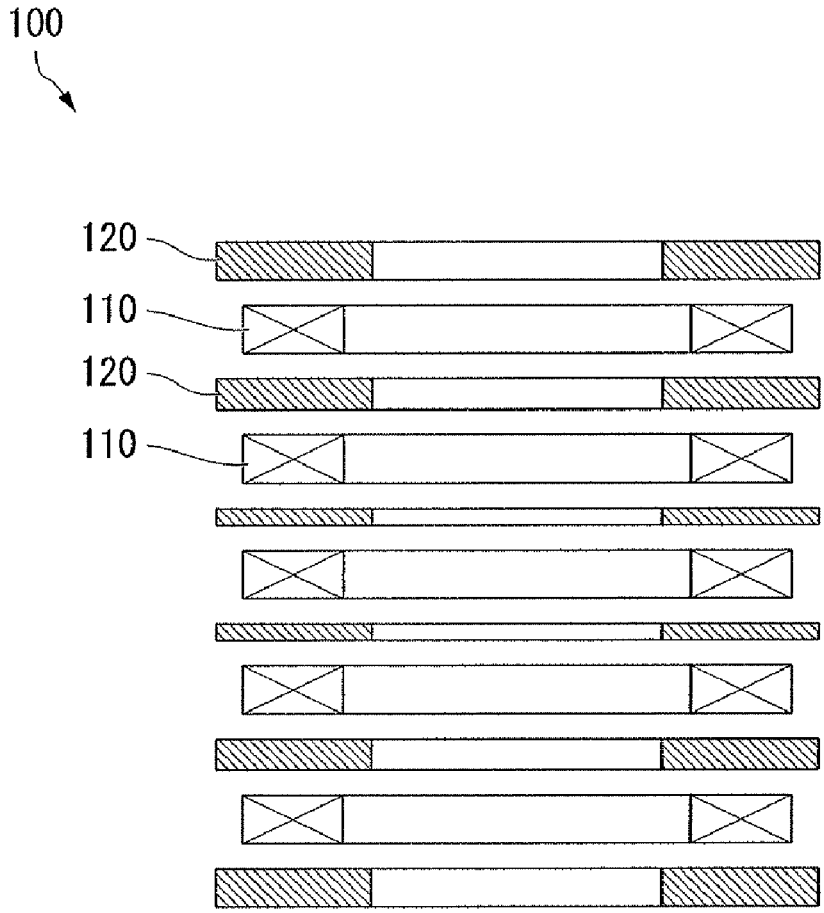
FIG. 2 is a cross-sectional view of a schematic configuration of a superconducting coil assembly according to the embodiment.

FIG. 2 is a cross-sectional view of a schematic configuration of the superconducting coil assembly 100 according to the embodiment.

Figure 3:
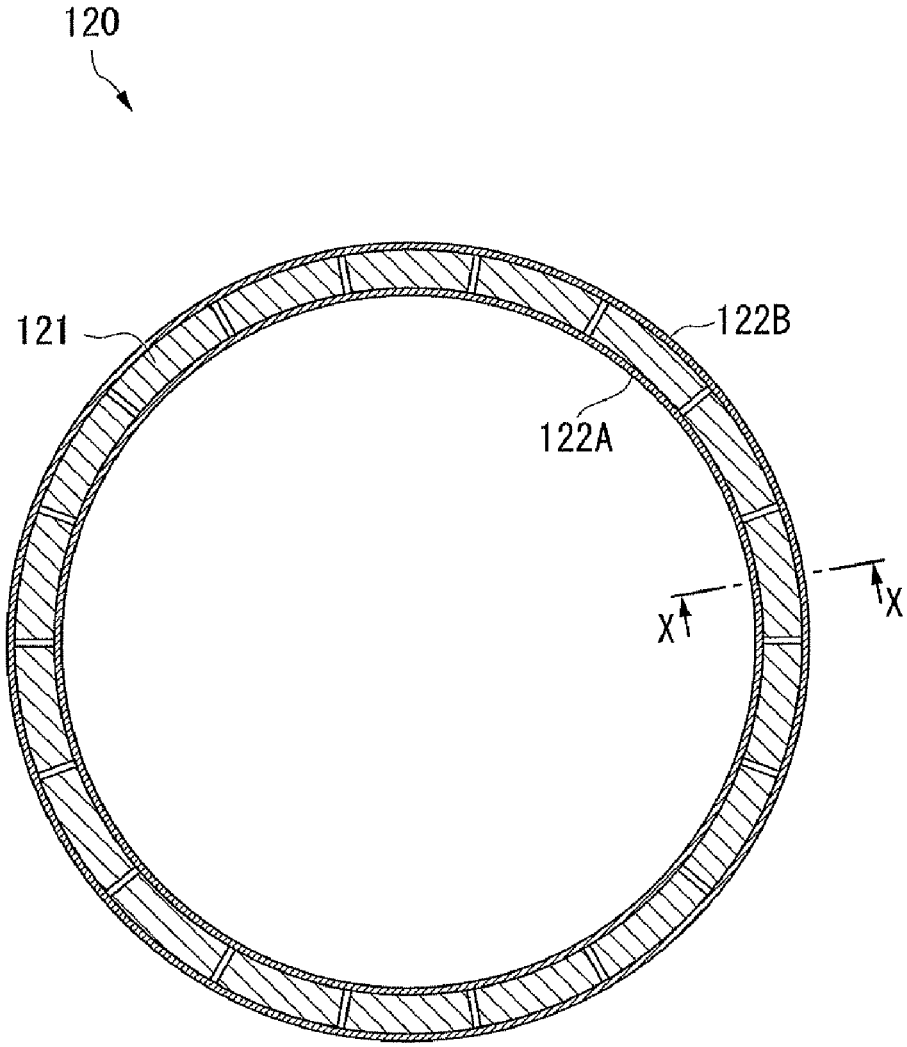
FIG. 3 is a plan view of a magnetic field-adjusting ring according to the embodiment.

FIG. 3 is a plan view of a magnetic field-adjusting ring 120 according to the embodiment.

Figure 4:
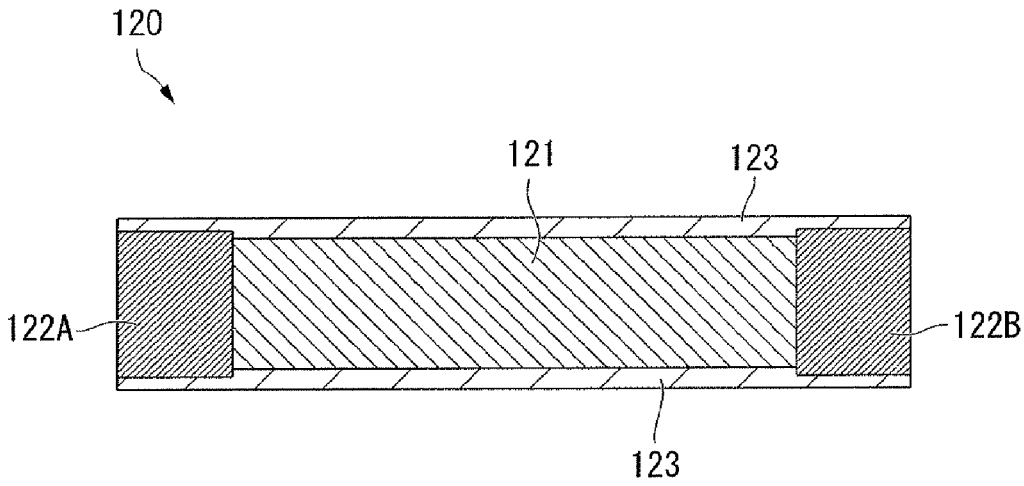
FIG. 4 is a cross-sectional view of the magnetic field-adjusting ring according to FIG. 3 taken along the line X-X.

FIG. 4 is a cross-sectional view of the magnetic field-adjusting ring 120 in FIG. 3 taken along the line X-X.

As shown in FIG. 2, the superconducting coil assembly 100 includes coil units 110 and magnetic field-adjusting rings 120. A gap as flow path of a cooling medium is provided between the coil unit 110 and the magnetic field-adjusting ring 120.

The coil unit 110 is, for example, a so-called double pancake coil formed by winding a tape-shaped superconducting material that is bismuth-based, yttrium-based, or such like, around a bobbin in a two-layered pancake shape in the axial direction. The coil unit 110 can also be formed using superconducting material with a single-winding, or one in the shape of a fan, a racetrack-winding, and so forth. A plurality of the coil units 110 are arranged with predetermined distances in the axial direction.

The magnetic field-adjusting ring 120 is a member having higher magnetic permeability than the superconducting material which constitutes the coil unit 110, and adjusts the strength of the magnetic field mainly in the direction perpendicular to the coil unit 110 (diameter direction). The magnetic field-adjusting rings 120 are positioned between the coil units 110 so as to sandwich each of them in the axial direction. As shown in FIG. 3, each magnetic field-adjusting ring 120 is ring-shaped.

As shown in FIG. 4, the magnetic field-adjusting ring 120 includes magnetic field adjusting members 121, an inner ring member 122A, an outer ring member 122B, and thin-plate members 123.

In the embodiment, the magnetic field adjusting members 121 are composed of ferrite, which has high electrical resistivity and high magnetic permeability. The ferrite is made by sintering of ferrite powder. Manganese ferrite can suitably be used.

As shown in FIG. 3, the magnetic field adjusting members 121 have the shape of a ring divided into a plurality of sections in the circumferential direction. This configuration is selected after considering from the aspect of difficulty in forming into a single ring-shaped piece due to the brittleness of ferrite, and from the aspect of suppressing electric current due to alternating magnetic field. The plan-view shape of the divided pieces of the magnetic field adjusting members 121 can be circular-arc, trapezoidal, or rectangular.

If the magnetic field adjusting members 121, which are soft magnetic material, have high electrical resistivity and conduct no current in alternating magnetic field, they need not to be divided in the circumferential direction, and can be formed into a single piece.

In order to suppress eddy current due to the alternating magnetic field, the adjacent magnetic field adjusting members 121 are arranged with a fixed distance between them in the circumferential direction, and are electrically insulated from each other. The circumferential-direction ends of each magnetic field adjusting members 121 are coated with adhesive, or insulating sheets are inserted between adjacent magnetic field adjusting members 121, thereby the distance between adjacent magnetic field adjusting members 121 can be shortened as much as possible or there are no gaps between the distance between adjacent magnetic field adjusting members 121.

The inner ring member 122A, the outer ring member 122B, and the thin-plate members 123 are members that together cover the magnetic field adjusting members 121 and hold it in a predetermined shape. The inner ring member 122A, the outer ring member 122B, and the thin-plate members 123 are composed of fiber-reinforced plastic (FRP), which is a composition of resin material and fiber material, from the aspect of the thermal shrinkage factor and strength.

The inner ring member 122A is positioned in the diameter-direction inner side of the ring shape of the magnetic field adjusting members 121. The outer ring member 122B is positioned in the diameter-direction outer side of the ring shape of the magnetic field adjusting members 121. That is, the magnetic field adjusting members 121 is positioned between the inner ring member 122A and the outer ring member 122B in the diameter direction. Moreover, the magnetic field adjusting members 121 are enclosed in the axial direction by the pair of thin-plate members 123 together by the inner ring member 122A and the outer ring member 122B.

In order to protect the brittle magnetic field adjusting members 121 from loads (e.g. a magnetic force acting on the magnetic field adjusting members 121 in the magnetic field, a force generated when fixing it to the coil stack, a force generated by difference in the thermal expansion coefficients between the ferrite and the resin material during cooling (or rising temperature), and so forth.), the inner ring member 122A and the outer ring member 122B are larger than the magnetic field adjusting members 121 in the axial direction.

The thin-plate members 123 are formed in a sheet-like shape with a predetermined thickness that does not obstruct heat release of the magnetic field adjusting members 121.

Since the magnetic field-adjusting ring 120 keeps its ring shape by the above-described configuration, and, when cracks appear in the brittle magnetic field adjusting members 121, the cracked piece can be prevented from protruding, whereby the desired functions can be maintained.

Returning to FIG. 2, the magnetic field-adjusting rings 120 of the above-described configuration have a width in the axial direction or width in the direction intersecting the axis (diameter direction) that depend on the magnetic field distribution of their arrangement position. That is, considering the characteristic that their magnetic field distribution depends on the position in the axial direction of the superconducting coil assembly 100, the sizes of the magnetic field-adjusting rings 120 (more specifically, the magnetic field adjusting members 121 within them) are designed different.

In the embodiment, since the magnetic field is high at both ends of the superconducting coil assembly 100, the width of the axial-direction of the magnetic field-adjusting ring 120 is designed large. On the other hand, since the magnetic field is low around the center of the superconducting coil assembly 100, the width of the axial-direction of the magnetic field-adjusting ring 120 is designed small. More precisely, the width of the axial-direction of the magnetic field-adjusting ring 120 gradually decreases from both ends of the superconducting coil assembly 100 toward its center.

Subsequently, effects of the magnetic field-adjusting ring 120 with the above-described configuration will be explained with reference to FIGS. 5A to 7B.

Figure 5A:
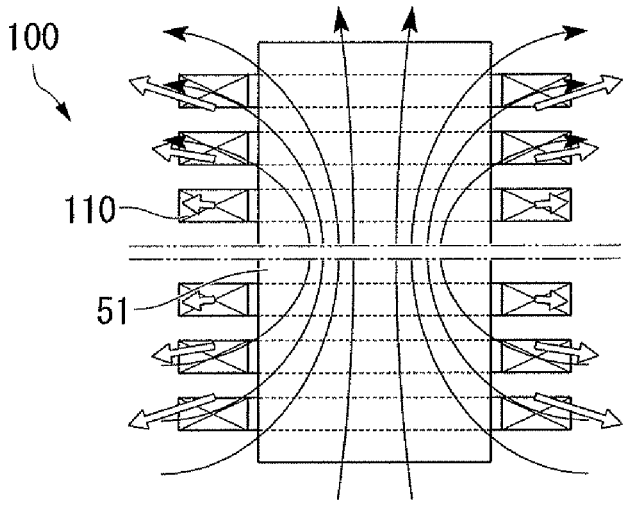
FIG. 5A is an explanatory schematic view of the effect of a magnetic field-adjusting ring according to the embodiment.
Figure 5B:
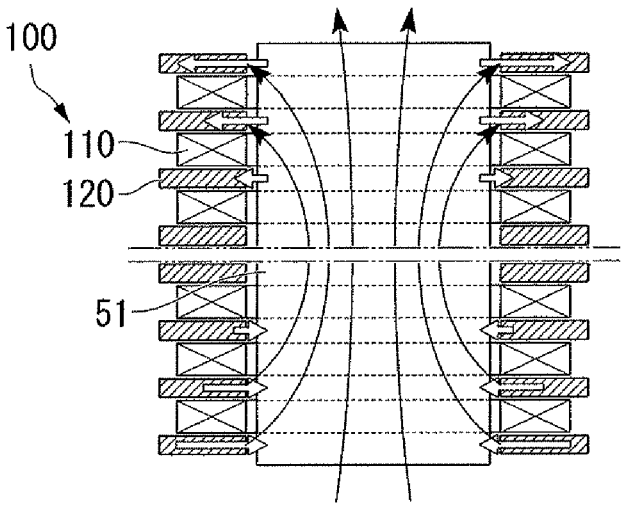
FIG. 5B is an explanatory schematic view of the effect of a magnetic field-adjusting ring according to the embodiment.

FIGS. 5A and 5B are explanatory schematic views of effects of the magnetic field-adjusting ring 120 according to an embodiment of the present invention.

Figure 6A:
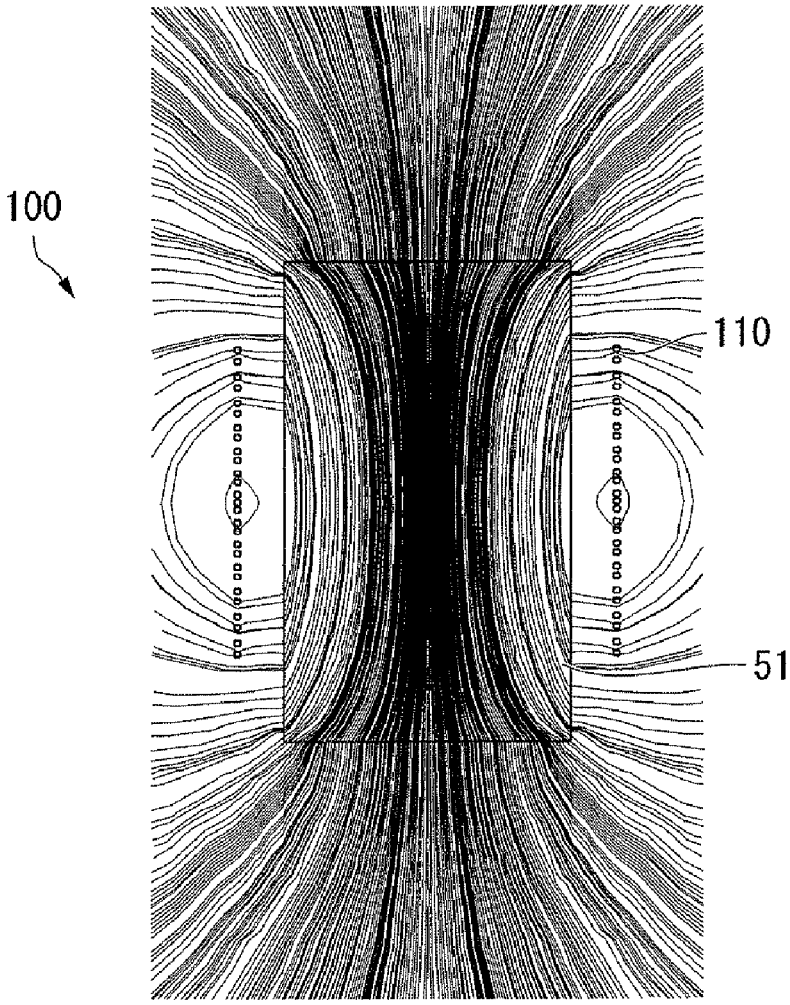
FIG. 6A is a simulation result of magnetic distribution of a superconducting coil assembly according to the embodiment.
Figure 6B:
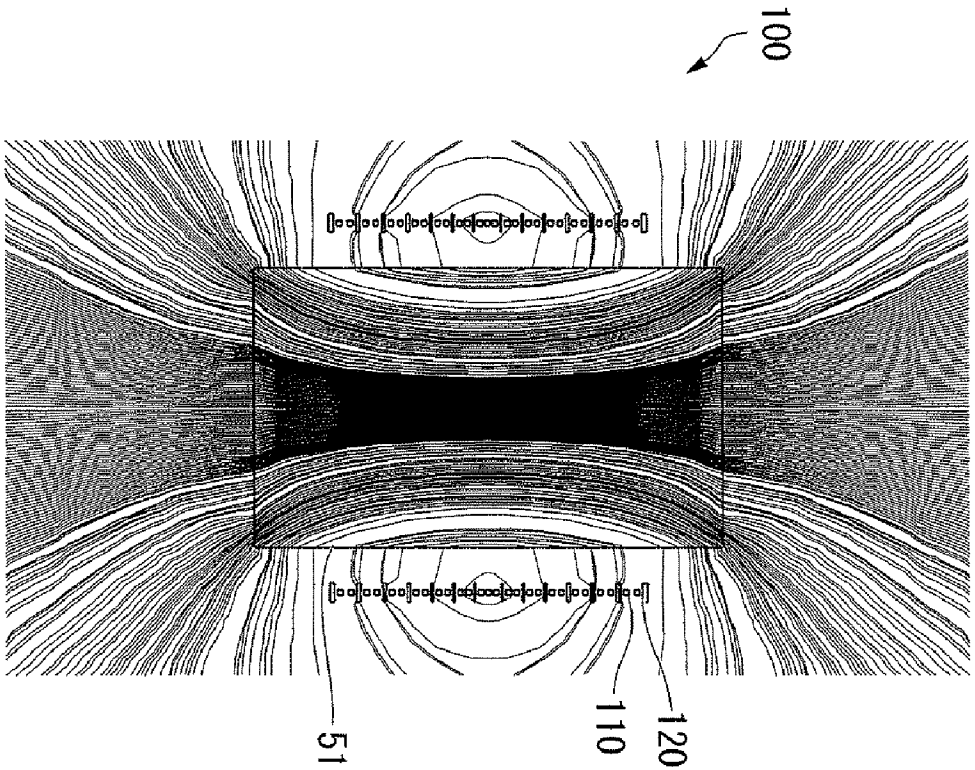
FIG. 6B is a simulation result of magnetic distribution of a superconducting coil assembly according to the embodiment.

FIGS. 6A and 6B are simulation results of magnetic distribution of the superconducting coil assembly 100 according to an embodiment of the present invention.

Figure 7A:
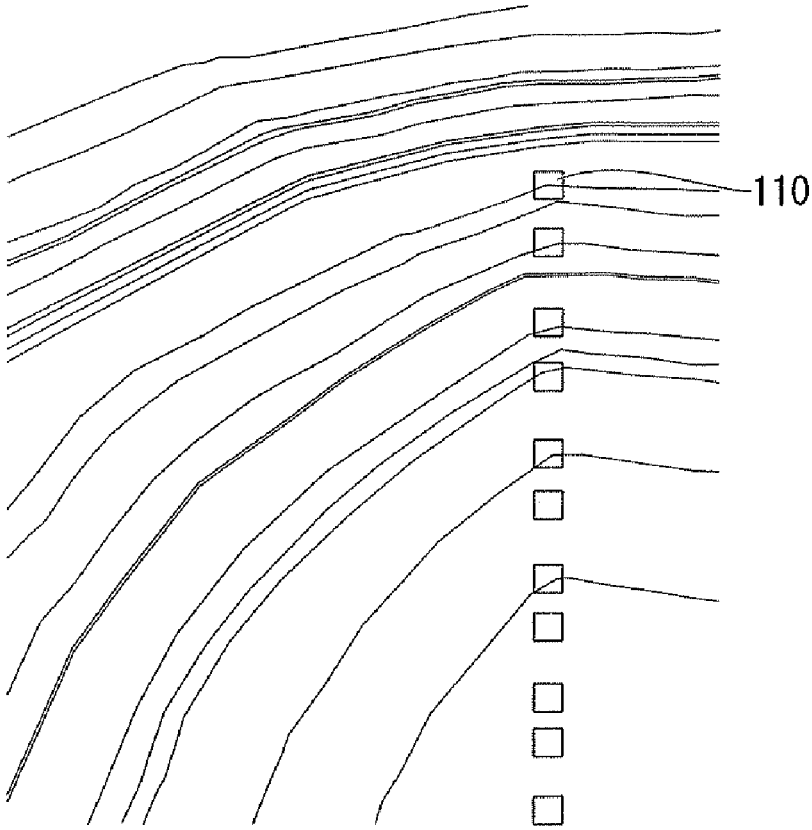
FIG. 7A is an enlarged view of an end part of the superconducting coil assembly according to FIG. 6.
Figure 7B:
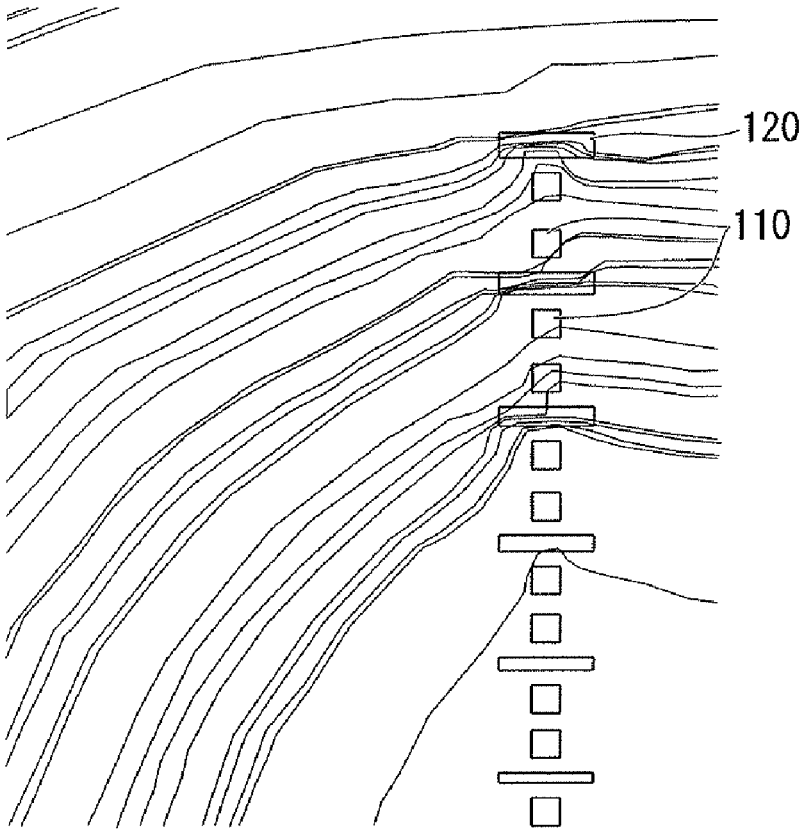
FIG. 7B is an enlarged view of an end part of the superconducting coil assembly according to FIG. 6.

FIGS. 7A and 7B are expanded views of an end part of the superconducting coil assembly 100 according to FIGS. 6A and 6B.

In FIGS. 5A to 7B, FIG. 5A illustrates a case where the magnetic field-adjusting rings 120 are not provided, and FIG. 5B illustrates a case where the magnetic field-adjusting rings 120 are provided. FIGS. 6A, 6B, 7A, and 7B are simulation results when the iron core 51 is arranged on the axis of the superconducting coil assembly 100.

When AC current is supplied to the superconducting coil assembly 100, a magnetic field is generated as shown in FIGS. 5A and 5B.

As shown in FIG. 5A, when the superconducting coil assembly 100 does not include the magnetic field-adjusting rings 120, the magnetic flux penetrates each coil unit 110 from the diameter direction of each coil unit 110. The critical current of the superconducting material forming the coil unit 110 deteriorates, and AC loss (heat) is generated. The phenomenon that the magnetic flux penetrates the coil units 110 can be also confirmed from the simulation results of FIG. 6A and FIG. 7A. The magnetic flux density is high at the axial-direction ends of the superconducting coil assembly 100. On the other hand, the magnetic flux density is low at the axial-direction center of the superconducting coil assembly 100.

Referring to FIG. 5B, a case where the superconducting coil assembly 100 includes the magnetic field-adjusting rings 120 will be explained. The magnetic field adjusting members 121 of the magnetic field-adjusting ring 120 consist of ferrite with a high magnetic permeability, and can sufficiently capture the magnetic flux. As seen in FIG. 5B, the magnetic field-adjusting rings 120 capture the magnetic flux penetrating each coil unit 110 from the diameter direction such that the magnetic flux is drawn toward the magnetic field-adjusting ring 120 provided in the vicinity of that coil unit 110, whereby the amount of magnetic flux penetrating each coil unit 110 can be reduced.

The capture of the magnetic flux by the magnetic field-adjusting rings 120 can be confirmed from the simulation results shown in FIGS. 6B and 7B.

As shown in FIG. 3, since the adjacent divided pieces of magnetic field adjusting members 121 are electrically insulated from each other, heat generation due to current generated by the AC magnetic field is prevented.

The magnetic field-adjusting rings 120 in the embodiment have axial-direction widths corresponding to their arrangement positions, and, as shown in FIGS. 6B and 7B, at the axial-direction ends of the superconducting coil assembly 100, the magnetic field-adjusting rings 120 need to capture more magnetic flux. In contrast, the magnetic field-adjusting rings 120 do not need to capture much magnetic flux around the axial-direction center, and the magnetic field-adjusting rings 120 have smaller axial-direction widths than widths of ones positioned at the axial-direction ends. By setting the axial-direction width as appropriate, it is possible to prevent the magnetic field-adjusting ring from having an inadequate effect on the nearby coil units 110 by the magnetization of the magnetic field adjusting ring itself, and to suppress heat generation of the ferrite.

As described above, the magnetic field-adjusting rings 120 can reduce the strength of the magnetic field acting on the superconducting material in the diameter direction, and suppress reduction of the critical current. In addition, the AC loss can also be reduced.

According to the embodiment, the superconducting coil assembly 100 is formed by arranging a plurality of coil units 110 composed of superconducting material coaxial to the same direction, and includes, in the vicinities of the coil units 110, magnetic field adjusting members 121 composed of ferrite having a higher magnetic permeability than the superconducting material. The magnetic field-adjusting ring 120 has high electrical resistivity, and suppresses eddy current. In addition, the magnetic field-adjusting ring 120 has high magnetic permeability, and can sufficiently capture magnetic flux.

Therefore, the embodiment can provide the superconducting coil assembly 100 that further suppresses a reduction in critical current, and suppresses AC loss.

Furthermore, in the embodiment, the magnetic field adjusting members 121 sandwich each coil unit 110 in the axial direction. Therefore, it is possible to capture the diameter-direction magnetic flux acting on each coil unit 110, and further reduce AC loss.

In the embodiment, the magnetic field adjusting members 121 include the axial-direction width which depends on the magnetic field distribution at their arranged positions. Therefore, when the size of the magnetic field adjusting members 121 are adjusted depending on the magnetic field distribution, the magnetic field adjusting members 121 can possess the performance to capture magnetic flux appropriate to their arrangement positions. It is also possible to prevent effects which are opposite to the object of the present invention from arising due to the abilities of the magnetic field adjusting members 121 to capture magnetic flux and to have the magnetization.

In the embodiment, the magnetic field adjusting member has the shape of a ring coaxial to the axis of the coil unit 110. Therefore, the magnetic field adjusting members 121 can capture magnetic flux in any direction acting on the coil unit 110 from the diameter direction.

In the embodiment, the inner ring member 122A provided on the diameter-direction inner sides of the magnetic field adjusting members 121, and the outer ring member 122B provided separately on the diameter-direction outer sides of the magnetic field adjusting members 121, are larger in the axial direction than the magnetic field adjusting members 121. Therefore, the inner ring member 122A and the outer ring member 122B can receive loads exerted on the magnetic field adjusting members 121 (e.g. a magnetic force acting on the magnetic body in the magnetic field, a force generated when securing it to the coil stack, a force generated by difference in the thermal expansion coefficients of the ferrite and the resin material during cooling (or rising temperature), etc.), whereby, even if the magnetic field adjusting members 121 are a brittle material such as ferrite, breaking and the like caused by load, impact and the like can be prevented.

In the embodiment, the superconducting motor 1 includes the superconducting assemblies 100 described above and generates a magnetic field using drive current supplied to the coil units 110 from outside. Therefore, the superconducting motor 1 which can suppress AC loss, can be operated stably and have high efficiently is achieved.

Although a preferred embodiment of the present invention has been described with reference to the drawings, it is not intended to be restrictive of the present invention. It will be understood that the shapes, combinations, and the like of the constituent members shown in the embodiment are merely examples, and can be modified in various ways for individual design demand based on the main points of the present invention.

For example, although in the embodiment, ferrite is used as the magnetic field adjusting members 121, this is not limitative of the present invention. For example, powder metallurgical core produced by pressing steel powder, or permendur powder, can also achieve the effects of the present invention.

In the embodiment, for example, the axial-direction width of the magnetic field-adjusting ring 120 is increased to adjust the capture characteristics of the magnetic flux. However, this configuration is not limitative of the present invention, it is acceptable to adjust the width in the direction orthogonal to the axis (diameter direction) depending on the magnetic field distribution at the arranged position. Incidentally, the ability to capture the magnetic flux varies depending on the diameter-direction width of the magnetic field-adjusting ring 120. Therefore, for example, the configuration which the diameter-direction width is large at the axial-direction ends of the superconducting coil assembly 100, while the diameter-direction width is small at the axial-direction center can be employed.

In the embodiment, for example, the magnetic field adjusting members 121 sandwich each coil unit 110 in the axial direction. However, this is not limitative of the present invention. For example, they can be provided inside of the coil unit, or can sandwich coil units at both ends in the axial direction. Moreover, the arrangement positions of the magnetic field adjusting members 121 can be selected in accordance with the magnetic field distribution. For example, the configuration in which the magnetic field adjusting members 121 are not provided at the axial-direction centers where the diameter-direction magnetic field is weak, or in which the magnetic field adjusting members 121 are not provided in certain region in the circumferential direction can be employed.

In the embodiment, for example, the magnetic field generating equipment that includes the superconducting coil assemblies 100 and generates a magnetic field using drive current supplied to the coil unit 110 from outside, is the superconducting motor 1. However, the present invention is not limited to this configuration, and can be applied in various types of magnetic field generating equipments such as, for example, a transformer, a power generator, and an electromagnet.

INDUSTRIAL APPLICABILITY

The magnetic field adjusting member of the present invention has high electrical resistance, suppresses the generation of eddy current, has high magnetic permeability, and can capture magnetic flux.

DESCRIPTION OF THE REFERENCE SYMBOLS

1 . . . SUPERCONDUCTING MOTOR (MAGNETIC FIELD GENERATING EQUIPMENT)
100 . . . SUPERCONDUCTING COIL ASSEMBLY
110 . . . COIL UNIT
121 . . . MAGNETIC FIELD ADJUSTING MEMBERS
122A . . . INNER RING MEMBER
122B . . . OUTER RING MEMBER

What is claimed is:

1. A superconducting coil assembly comprising:

a plurality of coil units composed of superconducting material each coil unit has an axis, and the coil units are arranged coaxial to a same axial direction;

magnetic field adjusting members composed of ferrite, powder metallurgical core, or permendur powder, which have higher magnetic permeability than the superconducting material and are provided in the vicinities of said coil units;

the magnetic field adjusting members each have the shape of a ring with a ring axis coaxial to each axis of said coil units; and inner ring members provided on diameter-direction inner sides of the magnetic field adjusting members, and outer ring members provided separately on diameter-direction outer sides of the magnetic field adjusting members, the inner and the outer ring members are larger than the magnetic field adjusting members in the axial direction.

2. The superconducting coil assembly according to claim 1, wherein the magnetic field adjusting members are provided between the coil units, so as to sandwich each coil unit in the axial direction, or so as to sandwich the coil units at both ends in the axial direction.

3. The superconducting coil assembly according to claim 1, wherein the magnetic field adjusting members have widths in the axial direction and/or widths in a direction orthogonal to the axis that depend on magnetic field distribution at arranged positions thereof.

4. A magnetic field generating equipment comprising the superconducting coil assembly according to claim 1, and the equipment being configured for generating a magnetic field using drive current supplied to each coil unit from outside.

* * * * *

UNITED STATES PATENT AND TRADEMARK OFFICE

CERTIFICATE OF CORRECTION

PATENT NO. : 8,354,907 B2
APPLICATION NO. : 13/057594
DATED : January 15, 2013
INVENTOR(S) : Fukaya et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 48 days.

Signed and Sealed this
First Day of September, 2015

Michelle K. Lee

Michelle K. Lee
*Director of the United States Patent and Trademark Office*